US007974557B2

(12) United States Patent
Wayman

(10) Patent No.: US 7,974,557 B2
(45) Date of Patent: Jul. 5, 2011

(54) CARRIER REPLENISHMENT AND IMAGE MOTTLE REDUCTION SYSTEM

(75) Inventor: William H Wayman, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 866 days.

(21) Appl. No.: 11/960,258

(22) Filed: Dec. 19, 2007

(65) Prior Publication Data

US 2009/0162102 A1 Jun. 25, 2009

(51) Int. Cl.
*G03G 15/08* (2006.01)

(52) U.S. Cl. ..... 399/258; 399/259; 399/260

(58) Field of Classification Search ..... 399/258–260
See application file for complete search history.

(56) References Cited

U.S. PATENT DOCUMENTS 6,094,547 A * 7/2000 Hart ..... 399/258 X
6,608,983 B2 8/2003 Terazawa et al.
2007/0053721 A1* 3/2007 Matsumoto et al. ..... 399/258

OTHER PUBLICATIONS

Wayman et al., U.S. Appl. No. 11/960,295, entitled "Teeter-Totter Valve For Carrier Replenishment System", filed simultaneously herewith.
William H. Wayman, U.S. Appl. No. 11/960,330, entitled "A Toner Image Reproduction Machine Including A Ball Valve Device Having A Pressure Release Assembly", filed simultaneously herewith.

* cited by examiner

*Primary Examiner* — David M Gray
*Assistant Examiner* — Erika Villaluna
(74) *Attorney, Agent, or Firm* — Oliff & Berridge, PLC

(57) ABSTRACT

A replenishment and image mottle reduction system for adding carrier particles to a developer housing in a two-component developer toner imaging machine. The replenishment system includes (i) a carrier-only hopper for receiving and containing a first quantity of carrier particles; (ii) metering valves connected to a discharge end of the carrier-only hopper; (iii) a pneumatic plenum connected to the metering valves; (v) an air blower connected to the carrier-only hopper and to the pneumatic plenum for pressurizing the carrier-only hopper and for pneumatically conveying a metered quantity of carrier particles in an air stream from the pneumatic plenum; and (vi) a carrier separator assembly connected to the pneumatic plenum, located above each developer housing and including a carrier current collector, for separating fresh carrier from the air stream, and for allowing the carrier separated as such to drop by gravity into the developer housing.

15 Claims, 2 Drawing Sheets

CARRIER REPLENISHMENT AND IMAGE MOTTLE REDUCTION SYSTEM

RELATED APPLICATIONS

This application is related to U.S. application Ser. No. 11/960,295 entitled "TEETER-TOTTER VALVE FOR CARRIER REPLENISHMENT SYSTEM" and U.S. application Ser. No. 11/960,330 entitled "A TONER IMAGE REPRODUCTION MACHINE INCLUDING A BALL VALVE DEVICE HAVING A PRESSURE RELEASE ASSEMBLY" both filed on the same date herewith, and having at least one common inventor.

BACKGROUND OF THE DISCLOSURE

The present disclosure relates generally to toner image reproduction machines, and more particularly, concerns such a machine utilizing two component (carrier particles and toner particles) developer, and including a carrier replenishment and image mottle reduction method and apparatus or system.

In a typical toner image reproduction machine, for example an electrostatographic printing process machine contained within a single enclosing frame, an imaging region of a toner image bearing member such as a photoconductive member is charged to a substantially uniform potential so as to sensitize the surface thereof. The charged portion of the photoconductive member is irradiated or exposed to a light image of an original document being reproduced. Exposure of the charged photoconductive member selectively dissipates the charges thereon in the irradiated areas. This records an electrostatic latent image on the photoconductive member corresponding to the informational areas contained within the original document.

After the electrostatic latent image is recorded on the photoconductive member, the latent image is developed at a development station by bringing a developer material in a developer housing into contact therewith. Generally, the developer material comprises magnetic carrier particles and toner particles that adhere triboelectrically to carrier particles. During development, the toner particles are attracted from the carrier particles to the latent image thereby forming a toner powder image on the photoconductive member. The toner powder image is then transferred from the photoconductive member to a copy sheet. The toner particles are then heated by a fusing apparatus within the single enclosed frame to permanently affix the powder image to the copy sheet.

Toner particles in the developer material in the developer housing accordingly become more and more depleted during image development as described above, ordinarily resulting in diminishing image quality. To maintain image quality, fresh toner particles therefore must be regularly added to the development. It has also been found that image quality, especial with respect to image mottle, can further also be improved by regularly also adding fresh carrier particles to the developer housing.

SUMMARY OF THE DISCLOSURE

Thus in accordance with the present disclosure, there has been provided a replenishment and image mottle reduction system for adding carrier particles to a developer housing in a two-component developer toner imaging machine. The replenishment system includes (i) a carrier-only hopper for receiving and containing a first quantity of carrier particles; (ii) metering valves connected to a discharge end of the carrier-only hopper; (iii) a pneumatic plenum connected to the metering valves; (v) an air blower connected to the carrier-only hopper and to the pneumatic plenum for pressurizing the carrier-only hopper and for pneumatically conveying a metered quantity of carrier particles in an air stream from the pneumatic plenum; and (vi) a carrier separator assembly connected to the pneumatic plenum, located above each developer housing and including a carrier current collector, for separating fresh carrier from the air stream, and for allowing the carrier separated as such to drop by gravity into the developer housing.

BRIEF DESCRIPTION OF DRAWINGS

The foregoing and other features of the instant disclosure will be apparent and easily understood from a further reading of the specification, claims and by reference to the accompanying drawing in that:

DETAILED DESCRIPTION

Figure 1:
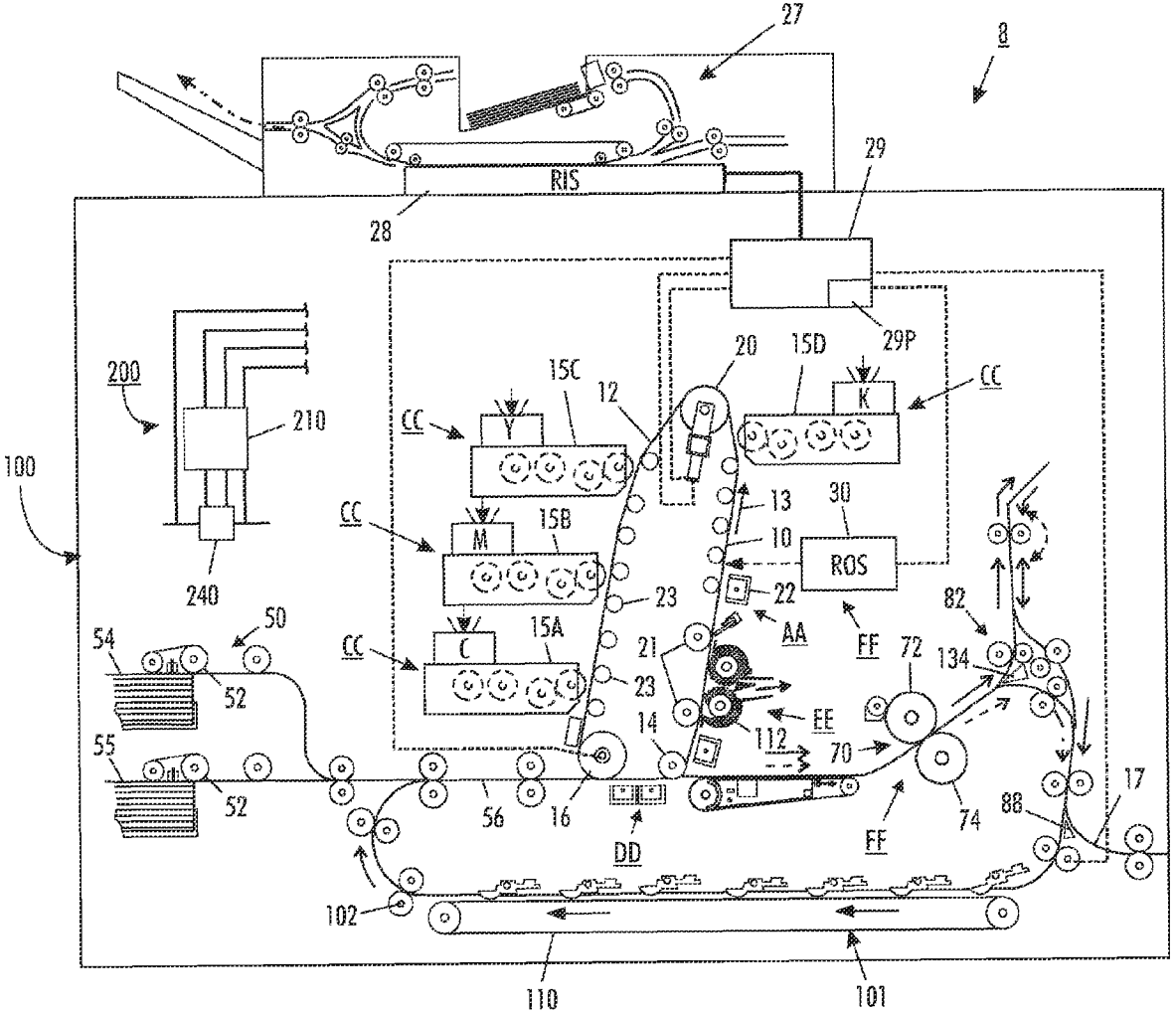
FIG. 1 is a schematic elevational view of the electrostatographic reproduction machine of the present disclosure including the carrier replenishment and image mottle reduction system in accordance with the present disclosure.

Referring first to the FIG. 1, it schematically illustrates an electrostatographic reproduction machine 8 that employs a photoconductive belt 10 mounted on a belt support module within a machine frame 11. Preferably, the photoconductive belt 10 is made from a photoconductive material coated on a conductive grounding layer that, in turn, is coated on an anti-curl backing layer. Belt 10 moves in the direction of arrow 13 to advance successive portions sequentially through various processing stations disposed about the path of movement thereof. Belt 10 is entrained as a closed loop about stripping roll 14, drive roll 16, idler roll 21, and backer rolls 23.

Initially, a portion of the photoconductive belt surface passes through charging station AA. At charging station AA, a charging wire of a corona-generating device indicated generally by the reference numeral 22 charges the photoconductive belt 10 to a relatively high, substantially uniform potential.

As also shown the reproduction machine 8 includes a controller or electronic control subsystem (ESS) 29 that is preferably a self-contained, dedicated minicomputer having a central processor unit (CPU), electronic storage, and a display or user interface (UI). The ESS 29, with the help of sensors and connections, can read, capture, prepare and process image data and machine component status information to be used for controlling operation of each such machine component.

Still referring to the FIG. 1, at an exposure station BB, the controller or electronic subsystem (ESS), 29, receives image signals from a raster input scanner (RIS) 28, representing a desired output image, and processes these signals to convert them to a continuous tone or gray scale rendition of the image that is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve equally as a remotely located printer for one or more computers. Alternatively, the printer may serve as a dedicated printer for a high-speed computer.

The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. At exposure station BB, the ROS 30 illuminates the portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the portion of photoconductive belt 10 on a raster-by-raster basis.

After the electrostatic latent image has been recorded on photoconductive surface 12, belt 10 advances the latent image through development station CC, that includes four two-component developer housings 15A, 15B, 15C, 15D as shown, each containing in-use (being used) two-component developer material, for example two-component developer material consisting of carrier particles and tribo-electrically CMYK color toner particles, one color per developer housing. At each developer housing 15A, 15B, 15C, 15D the toner particles contained in the developer material that is in-use are appropriately attracted electrostatically to, and develop the latent image.

As pointed out above, in-use developer material (that is, the mix of carrier and toner particles) in each developer housing typically becomes depleted of toner particles over time as toner particles are attracted to, and develop more and more images. This is one cause of poor image quality. Fresh toner particles hence have to be frequently and controllably added to the developer housing. Another cause of poor image quality has been found to be aging carrier (to be addressed below in accordance to the carrier replenishment and image mottle reduction system of the present disclosure).

With continued reference to FIG. 1, after the electrostatic latent image is developed, the toner powder image present on belt 10 advances to transfer station DD. A print sheet 48 is advanced to the transfer station DD, by a sheet feeding apparatus 50. Sheet-feeding apparatus 50 may include a corrugated vacuum feeder (TCVF) assembly 52 for contacting the uppermost sheet of stack 54, 55. TCVF 52 acquires each top copy sheet 48 and advances it to sheet transport 56. Sheet transport 56 directs the advancing sheet 48 into image transfer station DD to receive a toner image from photoreceptor belt 10 in a timed manner. Transfer station DD typically includes a corona-generating device 58 that sprays ions onto the backside of copy sheet 48. This assists in attracting the toner powder image from photoconductive surface 12 to sheet 48. After transfer, sheet 48 continues to move in the direction of arrow 60 where it is picked up by a pre-fuser transport assembly 101 and forwarded by means of a vacuum transport 110 to a fusing station FF that includes a fuser assembly 70.

The fuser assembly 70 for example, includes a heated fuser roller 72 and a pressure roller 74 with the powder image on the copy sheet contacting fuser roller 72. The pressure roller is crammed against the fuser roller to provide the necessary pressure to fix the toner powder image to the copy sheet. The fuser roller 72 is internally heated by a quartz lamp (not shown).

The sheet 48 then passes through fuser assembly 70 where the image is permanently fixed or fused to the sheet. After passing through fuser 70, a gate 88 either allows the sheet to move directly via output 17 to a finisher or stacker, or deflects the sheet into the duplex path 101. Specifically, the sheet (when being directed into the duplex path 101), is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 101, where that sheet will be inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, the residual toner/developer and paper fiber particles still on and may be adhering to photoconductive surface 12 are then removed therefrom by a cleaning apparatus 112 at cleaning station EE.

Still referring to FIG. 1, after passing through the fusing apparatus 70, a gate 88 either allows the sheet to move directly via output 17 to a finisher or stacker (not shown), or deflects the sheet into the duplex path 101. Specifically, the sheet (when being directed into the duplex path 101), is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 101, where that sheet will be inverted and then fed for recirculation back through the toner image forming module for receiving an unfused toner image on side two thereof.

Figure 2:
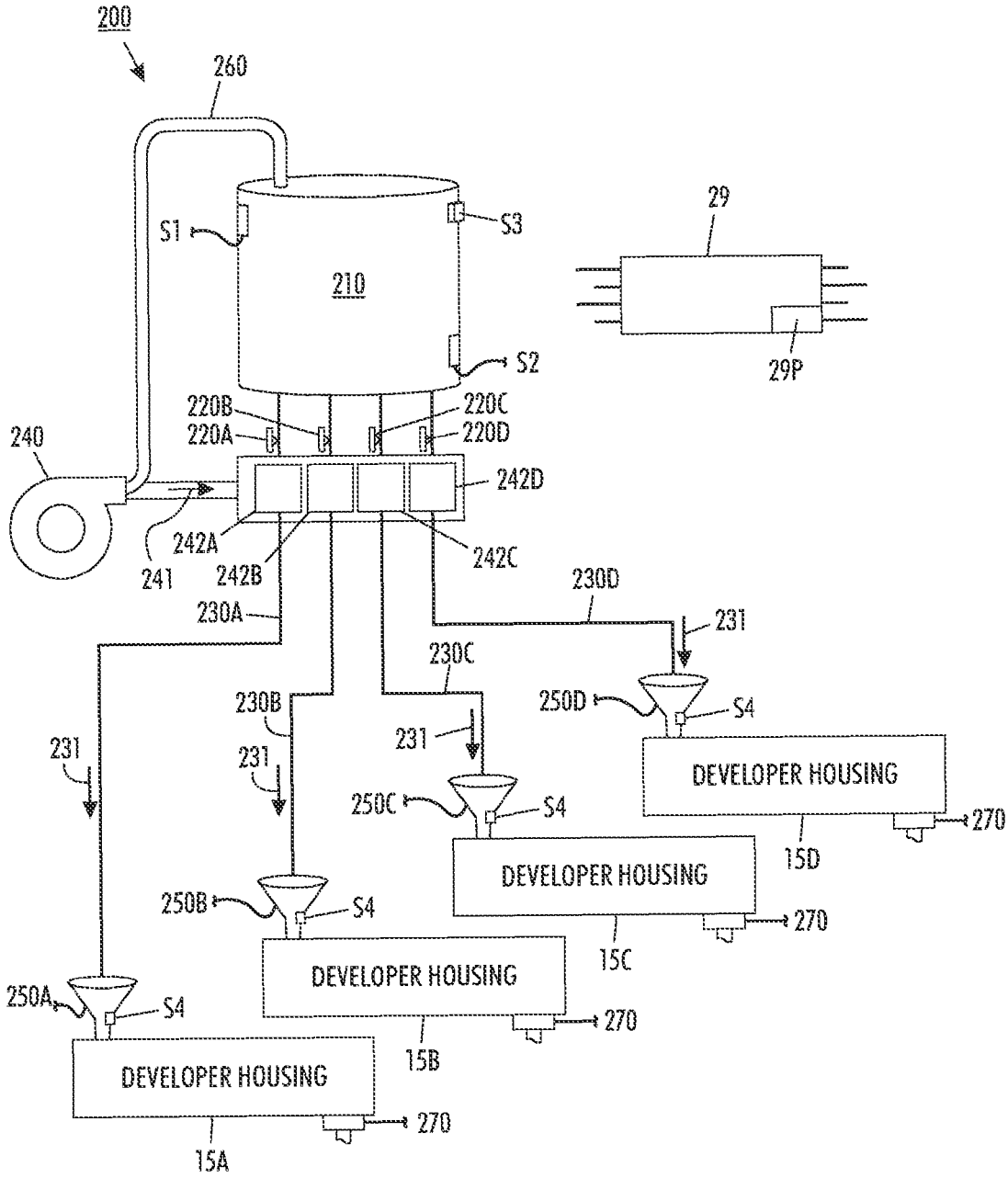
FIG. 2 is an enlarged schematic of carrier replenishment and image mottle reduction system of the present disclosure.

Referring now to FIGS. 1-2, in order to improve image quality by reducing image mottle, the development station CC (of the electrostatographic image reproduction machine 8, with two-component developer housings 15A, 15B, 15C, 15D) includes the carrier replenishment and image mottle reduction system (method and apparatus) 200 of the present disclosure for adding fresh carrier particles to each of the two-component developer housings 15A, 15B, 15C, 15D. As pointed out above, it has been discovered that adding fresh carrier to a developer housing 15A, 15B, 15C, 15D (at a steady rate for example) further improves image quality, particularly with respect to image mottle.

The carrier replenishment and image mottle reduction system 200 of the present disclosure includes a central carrier-only hopper 210, a series of metering valves 220A, 220B, 220C, 220D for each metering a small amount of fresh carrier particles from the carrier-only hopper, flexible tubing 230A, 230B, 230C, 230D, sensors S1, S2, and S3, current collector S4, a controller 29, 29P, an air blower 240 for providing pressurized air 241 to transport the carrier particles in an air stream 231 in the flexible tubing, and separator assemblies 250A, 250B, 250C, 250D for extracting the carrier particles from the air stream 231 and allowing them to drop by gravity into the developer housings. The carrier-only hopper 210 is a large stationary container for holding at least 18 lbs of fresh carrier particles. The benefits of the system as such include flexibility in placing the carrier-only hopper and in sharing it among several developer housings, improved image quality (mottle), lower costs, and increased reliability.

More specifically, in the fresh carrier replenishment and image mottle reduction system 200 a desired quantity of fresh carrier particles is metered from the pressurized storage carrier-only hopper 210 (a carrier-only hopper in the sense that there are no toner particles mixed with the carrier particles) through the metering valves 220A, 220B, 220C, 220D into a pneumatic transport assembly that includes a pneumatic plenum consisting of an "inverted T" plenum 242A, 242B, 242C, 242D for each metering valve, a small diameter flexible, transport tube 230A, 230B, 230C, 230D that may be static-dissipative, a separator assembly 250A, 250B, 250C, 250D and the compressed air blower 240. Each developer housing includes a "trickle" port 270 for allowing overflow of in-use developer material. In this way the developer housing sump level remains constant even though fresh carrier is being added.

The compressed air blower 240 is connected to each of the "inverted T" plenums 242A, 242B, 242C, 242D for supplying a pressurized air stream 231 therethrough into the transport tube 230A, 230B, 230C, 230D. The air blower is also connected through a tube 260 to the carrier-only hopper for pressurizing it to a desired level.

As shown, in a color image printing machine such as the machine 8 with a plurality of developer housings 15A, 15B, 15C, 15D, (that is, with a different developer housing 15A, 15B, 15C, 15D for each color toner e.g. CYMK color toners), the carrier replenishment and image mottle reduction system 200 has a separate transport assembly (metering valve, plenum, flexible tube and separator assembly) for each such developer housing 15A, 15B, 15C, 15D. Accordingly as shown, there are for example 4 different metering valves 220A, 220B, 220C, 220D; 4 different "inverted T" plenums 242A, 242B, 242C, 242D; 4 different small diameter tubes 230A, 230B, 230C, 230D; and 4 different separators assemblies 250A, 250B, 250C, 250D.

As stated above, the carrier-only storage hopper 210 is pressurized, and can for example be maintained at the same air pressure level as the metering valves 220A, 220B, 220C, 220D and the transport tube 230A, 230B, 230C, 230D in order to eliminate any pressure drop across the metering valves 220A, 220B, 220C, 220D. This advantageously allows the metering valves 220A, 220B, 220C, 220D, to work by gravity and not be sensitive to any differential air pressure across the valves. Because of this, the carrier-only hopper 210 cannot be vented at any time (including during refilling thereof) to atmospheric pressure because that will create a pressure difference across the metering valves, and thus block the gravitational flow of carrier through the valves.

Various tubing sizes were tested and it was found that as long as a minimum air velocity of about 40 feet/sec is used, the small quantity of carrier particles for an individual developer housing will be efficiently transported in any reasonable size tube 230A, 230B, 230C, 230D.

In operation for example, the air blower provides about 10"H2O pressure thus creating about 0.73 cu/ft/min of air flow in a ¼" internal diameter flexible plastic tube 230A, 230B, 230C, 230Ds that are each about 10 feet in length. The velocity of each air flow or air stream 231 under such conditions is about 36 feet/sec. For each developer housing 15A, 15B, 15C, 15D, a determined small quantity of fresh carrier particles is volumetrically metered by the dedicated metering valve 220A, 220B, 220C, 220D, and is for example dropped by gravity vertically into the inverted "mixing T" plenum 242A, 242B, 242C, 242D. With the controller 29, 29P, a predetermined quantity of fresh carrier particles can be metered at a fixed rate, or at a controlled variable rate.

The air stream 231 for each tube 230A, 230B, 230C, 230D from the air blower 240 is introduced horizontally across the bottom of the inverted "mixing T" plenum 242A, 242B, 242C, 242D. The metered carrier particles on reaching the inverted "mixing T" plenum 242A, 242B, 242C, 242D combine with the horizontally moving air stream 231 and move as a carrier laden air stream along the flexible tube 230A, 230B, 230C, 230D to the separator assembly 250A, 250B, 250C, 250D.

The fresh carrier replenishment and image mottle reduction system 200 as such effectively keeps the age of in-use carrier, i.e. the mean carrier residence time in each developer housing 15A, 15B, 15C, 15D, at a level below a predetermined failure point. This thereby assures a reduction in image quality problems such as image mottle. This is because at or near the predetermined "failure" point, image quality degrades rapidly with respect to streaks, mottle, and emissions related failures somewhere between 60K and 80K developer life.

As additionally illustrated, the fresh carrier replenishment and image mottle reduction system includes a hopper fill point sensor S1; a hopper low carrier level sensor S3; a hopper low pressure sensor S2; and carrier current collectors S4 (4 of them) that form part of each separator assembly 250A, 250B, 250C, 250D. Each separator assembly 250A, 250B, 250C, 250D for example is made from conductive material and is electrically isolated from ground. As such, it acts as a static charge collector for tribo-electric (static) charge created by the carrier that became charged by flowing in the air stream and rubbing against the inside of the transport tubes 230A, 230B, 230C, 230D.

A carrier current collector S4 is therefore provided in each separator for collecting tribo-electric (static) charge current from charged carrier flowing through the separator to the developer housing 15A, 15B, 15C, 15D. The current collector S4 is connected to the controller 29, 29P and the current is measured by the replenishment control program 29P. This connection allows for detecting faults, such as clogging within any metering valve or tubing that does not allow carrier to arrive at the separator and hence into the developer housing as desired.

The fresh carrier replenishment program 29P for example utilizes inputs from the various sensors S1, S2, S3, S4 in the system as described above, and may include constant and variable rate fresh carrier replenishment software. Additionally it includes an enable/disable function for each developer housing 15A, 15B, 15C, 15D, with separate processor controlled variable dispense rates. This may be coupled with fault declarations for the presence/absence of fresh carrier particles arriving at the separator, detection of an empty hopper, and the appropriate actions for each condition. These functions may be integrated with developer housing motor operation so that if the developer housing motor is running, then and only then will the fresh carrier replenishment and image mottle reduction system be operational.

Accordingly, the present disclosure is directed to a carrier replenishment and image mottle reduction system 200 for adding fresh carrier particles to two-component developer housings 15A, 15B, 15C, 15D in an electrostatographic toner image reproduction machine. The carrier replenishment and image mottle reduction system 200 includes (a) a carrier-only hopper 210 for receiving and containing a first quantity of fresh carrier particles; (b) metering valves 220A, 220B, 220C, 220D connected to a discharge end of the carrier-only hopper for stopping and allowing flow of fresh carrier particles from the carrier-only hopper (c) a pneumatic plenum connected to the metering valves; (d) an air blower 240 connected to the pneumatic plenum for pneumatically conveying fresh carrier particles away from the pneumatic plenum; and (e) carrier separator assemblies 250A, 250B, 250C, 250D each including a carrier current collector S4. Each of the carrier separator assemblies is connected to the pneumatic plenum and is located above each of the two-component developer housings 15A, 15B, 15C, 15D for separating fresh carrier particles from an air stream 231 from the pneumatic plenum, and for allowing the carrier particles separated thus to drop by gravity into the two-component developer housings.

The air blower 240 is also connected to the carrier-only hopper 210 for pressurizing the carrier-only hopper, and a pressure sensor is connected to the carrier-only hopper for monitoring pressure levels to assure proper carrier flow from the carrier-only hopper through each of the metering valves. The carrier-only hopper is pressurized to the same pressure level as each of the metering valves. The carrier replenishment and image mottle reduction system also includes flexible air stream carrying tube 230A, 230B, 230C, 230D that connect the pneumatic plenum to each of the carrier separator assemblies 250A, 250B, 250C, 250D.

The method of the fresh carrier replenishment and image mottle reduction system 200 for reducing image mottle in a two-component developer imaging machine 8 having a controller 29, 29P, and two-component developer housings 15A, 15B, 15C, 15D containing in-use two-component developer including carrier particles and toner particles, includes (a) providing a carrier-only hopper 210 containing fresh carrier particles; (b) connecting the carrier-only hopper to each of the two-component developer housings; (c) dispensing a small amount of in-use two-component developer from each of the two-component developer housings; and (d) metering and adding a predetermined quantity of fresh carrier particles from the carrier-only hopper 210 into each the two-component developer housings at a desired rate for increasing a composition of fresh carrier particles in the in-use two-component developer in each the two-component developer housings, thereby reducing image mottle and improving image quality.

The metering step comprises metering the predetermined quantity of fresh carrier particles at a fixed rate, or at a controlled variable rate. The method further includes a step of pneumatically blowing the predetermined quantity of fresh carrier particles in an air stream through a carrier transport system into each the two-component developer housings. It also includes a step of separating, in a separator assembly 250A, 250B, 250C, 250D, the predetermined quantity of fresh carrier from the air stream and allowing the fresh carrier separated thus to drop by gravity into each the two-component developer housings.

As can be seen, there has been provided a fresh carrier replenishment and image mottle reduction system for adding carrier particles to a developer housing in a two-component developer toner imaging machine. The replenishment system includes (i) a carrier-only hopper for receiving and containing a first quantity of carrier particles; (ii) metering valves connected to a discharge end of the carrier-only hopper; (iii) a pneumatic plenum connected to the metering valves; (v) an air blower connected to the carrier-only hopper and to the pneumatic plenum for pressurizing the carrier-only hopper and for pneumatically conveying a metered quantity of carrier particles in an air stream from the pneumatic plenum; and (vi) a carrier separator assembly 2connected to the pneumatic plenum, located above each developer housing and including a carrier current collector, for separating fresh carrier from the air stream, and for allowing the carrier separated as such to drop by gravity into the developer housing.

It will be appreciated that various ones of the above-disclosed and other features and functions of this embodiment, or alternatives thereof, may be desirably combined into other different systems or applications. Also that various presently unforeseen or unanticipated alternatives, modifications, variations or improvements therein may be subsequently made by those skilled in the art which are also intended to be encompassed by the following claims.

What is claimed is:

1. A carrier replenishment and image mottle reduction system for adding fresh carrier particles to two-component developer housings, the carrier replenishment and image mottle reduction system including:

(a) a carrier-only hopper for receiving and containing a first quantity of fresh carrier particles;

(b) metering valves connected to a discharge end of said carrier-only hopper for stopping and allowing flow of fresh carrier particles from said carrier-only hopper;

(c) a pneumatic plenum connected to said metering valves;

(d) an air blower connected to said pneumatic plenum for pneumatically conveying fresh carrier particles away from said pneumatic plenum; and (e) carrier separator assemblies each including a carrier current collector, each said carrier separator assemblies being connected to said pneumatic plenum and located above each said two-component developer housings for separating fresh carrier particles from an air stream from said pneumatic plenum, and for allowing the carrier particles separated thus to drop by gravity into said each two-component developer housings.

2. The carrier replenishment and image mottle reduction system of claim 1, wherein said air blower is connected to said carrier-only hopper for also pressurizing said carrier-only hopper.

3. The carrier replenishment and image mottle reduction system of claim 2, including a pressure sensor connected to carrier-only hopper for assuring proper carrier flow from the carrier-only hopper through each of said metering valves.

4. The carrier replenishment and image mottle reduction system of claim 3, wherein said carrier-only hopper is pressurized to the same pressure level as each said metering valves.

5. The carrier replenishment and image mottle reduction system of claim 1, including a flexible air stream carrying tube connecting said pneumatic plenum to each said carrier separator assemblies.

6. A toner development station in an electrostatographic image reproduction machine for developing quality toner images having reduced image mottle, the toner development station comprising:

(a) two-component developer housings each containing in-use two-component developer material including toner particles and carrier particles; and (b) a carrier replenishment and image mottle reduction system for adding fresh carrier particles to said each two-component developer housings, the carrier replenishment and image mottle reduction system including:

(i) a carrier-only hopper for receiving and containing a first quantity of fresh carrier particles;

(ii) metering valves connected to a discharge end of said carrier-only hopper for stopping and allowing flow of fresh carrier particles from said carrier-only hopper;

(iii) a pneumatic plenum connected to said metering valves;

(iv) an air blower connected to said carrier-only hopper and to said pneumatic plenum for pressurizing said carrier-only hopper and for pneumatically conveying fresh carrier particles away from said pneumatic plenum; and (v) a carrier separator assembly including a carrier current collector, said carrier separator assembly being connected to said pneumatic plenum and located above each said two-component developer housings for separating fresh carrier particles from an air stream from said pneumatic plenum, and for allowing the carrier particles separated thus to drop by gravity into said each two-component developer housings.

7. The toner development station of claim 6, wherein said air blower is connected to said carrier-only hopper for also pressurizing said carrier-only hopper.

8. The toner development station of claim 7, including a pressure sensor connected to said carrier-only hopper for assuring proper carrier flow from the carrier-only hopper through each of said metering valves.

9. The toner development station of claim 8, wherein said carrier-only hopper is pressurized to the same pressure level as each said metering valves.

10. The toner development station of claim 6, including a flexible air stream carrying tube connecting said pneumatic plenum to each said carrier separator assemblies.

11. An electrostatographic image reproduction machine comprising:

(a) a moveable imaging member including an imaging surface;

(b) imaging means for forming a latent image on said imaging surface;

(c) a toner development station including two-component developer housings each containing in-use two-component developer material having toner particles and carrier particles for developing said latent images; and (d) a carrier replenishment and image mottle reduction system for adding fresh carrier particles to said each two-component developer housings, the carrier replenishment and image mottle reduction system including:

(i) a carrier-only hopper for receiving and containing a first quantity of fresh carrier particles;

(ii) metering valves connected to a discharge end of said carrier-only hopper for stopping and allowing flow of fresh carrier particles from said carrier-only hopper;

(iii) a pneumatic plenum connected to said metering valves;

(iv) an air blower connected to said carrier-only hopper and to said pneumatic plenum for pressurizing said carrier-only hopper and for pneumatically conveying fresh carrier particles away from said pneumatic plenum; and (v) a carrier separator assembly including a carrier current collector, said carrier separator assembly being connected to said pneumatic plenum and located above each said two-component developer housings for separating fresh carrier particles from an air stream from said pneumatic plenum, and for allowing the carrier particles separated thus to drop by gravity into said each two-component developer housings.

12. The electrostatographic image reproduction machine of claim 11, wherein said air blower is connected to said carrier-only hopper for also pressurizing said carrier-only hopper.

13. The electrostatographic image reproduction machine of claim 12, including a pressure sensor connected to said carrier-only hopper for assuring proper carrier flow from the carrier-only hopper through each of said metering valves.

14. The electrostatographic image reproduction machine of claim 13, wherein said carrier-only hopper is pressurized to the same pressure level as each said metering valves.

15. The electrostatographic image reproduction machine of claim 11, including a flexible air stream carrying tube connecting said pneumatic plenum to each said carrier separator assemblies.

* * * * *